United States Patent [19]

Watanabe et al.

[11] 4,258,350

[45] Mar. 24, 1981

[54] ARRANGEMENT OF PLUG-IN TYPE FUSES ON A MOUNTING BOARD

[75] Inventors: Kiyoto Watanabe, Yokohama; Syuichi Otani, Tokyo, both of Japan

[73] Assignee: Nissan Motor Company, Limited, Yokohama, Japan

[21] Appl. No.: 25,144

[22] Filed: Mar. 29, 1979

[30] Foreign Application Priority Data

Mar. 30, 1978 [JP] Japan ..... 53-41840[U]

[51] Int. Cl.[3] ..... H01H 85/16

[52] U.S. Cl. ..... 337/198; 361/331; 361/383; 361/431

[58] Field of Search ..... 339/147 R, 176 R, 198 S, 339/258 F, 65, 66 R; 361/349, 383, 388, 430, 432, 403, 418, 431, 427; 337/198, 194, 256, 257, 261, 262; 174/138 G

[56] References Cited

U.S. PATENT DOCUMENTS

| | | | |
|---|---|---|---|
| 3,474,394 | 10/1969 | Hammell et al. | 339/176 R |
| 3,880,491 | 4/1975 | Ferro et al. | 339/176 R |
| 3,909,767 | 9/1975 | Williamson et al. | 337/264 |
| 4,097,109 | 6/1978 | Cross | 339/258 F |

*Primary Examiner*—William H. Beha, Jr.

*Attorney, Agent, or Firm*—Schwartz, Jeffery, Schwaab, Mack, Blumenthal & Koch

[57] ABSTRACT

The improved arrangement of plug-in fuses comprises multiple fuse assemblies each comprising a fuse body and a housing enclosing the fuse body, the fuse body having two parallel terminal blade portions with their both ends projecting from the housing which ends are fitted in small slit-shape socket openings formed in a fuse mounting board, and retaining pieces fixed on the mounting board for retaining the housing upright.

3 Claims, 3 Drawing Figures

ARRANGEMENT OF PLUG-IN TYPE FUSES ON A MOUNTING BOARD

BACKGROUND OF THE INVENTION

This invention generally concerns a current overload fuse assembly and particularly an improved arrangement of plug-in type fuse elements in a fuse mounting board.

So far known is a plug-in type fuse which consists of an elongate housing made of insulating material and a single piece metal fuse strip enclosed in the housing with ends of two parallel terminal forming blades downwardly projected from the housing. A fuse link enveloped by the housing interconnects current carrying extensions of the terminal forming blades.

The fuse elements of this type have been heretofore mounted on a fuse board in a manner that the housings are sunk into socket openings machined into the mounting board with only their top covers emerging from the mounting board.

One disadvantage of this kind of fuse arrangement is that the fuses are only insufficiently cooled off as the major part of the fuse element is confined under the mounting board and not exposed to the ambient air. Also, the deeply sunk fuses must be pulled out of the socket openings when the fuses are to be exchanged, requiring much attention for exchange operation.

It is therefore a primary object of the invention to provide an arrangement of fuse elements on a mounting board which eliminates the aforementioned inconveniences.

Another object of the invention is to provide an improved arrangement of plug-in type fuse elements on a mounting board in which the housings of fuse elements are supported to stand upright on the mounting board at a certain limited space from one another to expose the major part of each fuse element to fresh cold air.

A further important object of the invention is to provide an improved arrangement of plug-in type fuse elements on a mounting board in which a multiplicity of such fuse elements is compactly arranged on a mounting board within a relatively small area.

Still a further object of the invention is to provide an improved arrangement of plug-in type fuse elements on a mounting board in which the fuse elements are retained on the surface of the mounting board and can be easily detached from the mounting board when they are to be exchanged.

SUMMARY OF THE INVENTION

In accordance with the improved arrangement of the invention, socket openings are generally equidistantly arranged on the mounting board, the openings being of slit shape small enough to receive only the ends of the fuse element projecting downwardly from the fuse housings. Adjacent the socket openings are retaining pieces standing upright on the mounting board at suitable spaces. In an assembled state, the bottom ends of the fuse elements projected from the housings are inserted into the socket openings, and each housing of the fuse elements is supported between at least two adjoining retaining pieces to stand upright on the mounting board.

Further objects, features and advantages according to the invention are hereinafter explained in connection with a single preferred embodiment compared with a prior art example, reference being made to the accompanying drawings.

DETAILED DESCRIPTIONS OF THE PRIOR ART AND THE INVENTION

Figure 1:
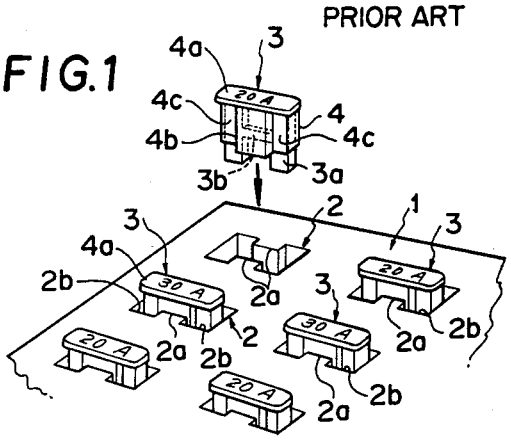
PRIOR ART FIG.1
FIG. 1 is a schematic perspective view showing one prior art example of a fuse arrangement.

First, a prior art fuse arrangement is specifically explained below in conjunction with FIG. 1 to elucidate the difference of the arrangement according to the invention from that of the prior art.

A plug-in type, current overload fuse assembly known per se comprises a fuse body 3 made of a stamping from a single piece of fuse metal and a generally box shape housing 4 of insulating material. A fuse link **3*b* interconnects current carrying extensions of parallel terminal-forming blades 3*a*. The fuse body 3 thus formed is enclosed in the housing 4 except the bottom ends of the blades 3*a* projecting downwardly from the interior of the housing 4. Center parts 4*b* on the wide side walls of the housing are stepwise raised generally throughout the vertical height of the housing. The top of the housing is closed by a cover head 4*a*** which is appreciably larger than the cross sectional area of the housing body.

An index such as 20A is printed on the outer wall surface of the cover head **4*a*** to indicate the current rating of the fuse in the usual manner.

Socket openings 2 are formed in a mounting board 1 at suitable spaces from one another and are also generally of box section. The depth of the openings is such that the whole housing except the cover head can be inserted. Two wider side walls defining the socket opening are at their center parts **2*a* projected inwardly of the opening. Thus, the housing 4 when inserted into the opening 2 is at the raised center parts 4*b* gripped between the two projections 2*a*. It is readily seen that the recessed parts 4*c* on both sides of the raised center part 4*b* are substantially spaced from the walls 2*b*** defining the socket opening excepting the center projections.

According to the prior art arrangement as explained above, heat accumulated on the fuse must be dissipated through the small clearance which is defined by the walls **4*c* of the housing and the walls 2*b*** of the socket opening. Only limited rate of air flow is admitted into and out of such small clearance so that ventilation and cooling effects are very poor, eventually resulting in overheating the fuse element without current overloading.

If the heat generated at the fuse elements were to be reduced by limiting the current rating per fuse, little cooling-off requirement would occur at the aforedescribed prior arrangement as it is. It would be apparent however that to obtain the same total current rating, the number of the fuse elements must be increased incurring extra expenses for the increased number of fuse elements and for the enlarged mounting board.

Enlarging the clearances between the housings and the socket openings for better cooling effect is also impractical because correspondingly, the distances between the individual socket openings should be increased, again requiring an enlarged mounting board.

In view of the aforedescribed circumstances, the present invention proposes an improved arrangement of fuse elements on the mounting board in which each fuse assembly is exposed to the ambient air instead of being hidden within the mounting board so that it always contacts fresh air as a coolant to eliminate the overheating problem.

Figure 2:
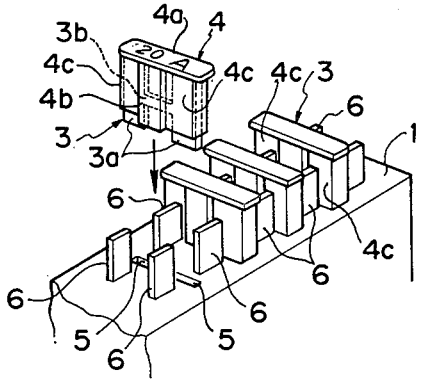
FIG. 2 is a schematic perspective view of an improved fuse arrangement according to a preferred embodiment of the invention.
Figure 3:
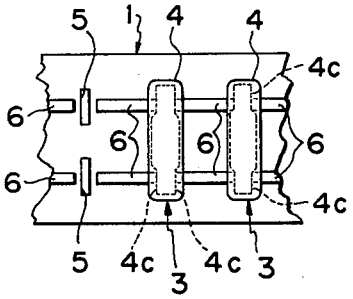
FIG. 3 is a top plan view of the fuse arrangement illustrated in FIG. 2.

Reference is now made to FIGS. 2 and 3 illustrating a preferred embodiment of the invention.

The fuse assembly used herein is of the same type and configuration as that described in connection with the prior art example an consists of a fuse body 3 and a housing 4, though other suitable types of fuses can be used if preferred.

According to the invention, the socket opening consists of two longitudinally spaced, aligned slits 5 of a size in which the ends of the terminal blades 3*a* projected from the housing can be fitted.

Plate-shape retaining pieces 6 stand on and are fastened to the surface of the mounting board 1. The retaining pieces 6 are arranged in alignment with each other in two parallel juxtaposed rows extending generally at right angle to the slits. The individual retaining pieces in any one of the parallel rows are generally equidistantly spaced from each other and slits 5 lie inbetween the adjacent retaining pieces.

In an assembled state, the bottom ends of the terminal blades 3*a* are fitted into the slit-like openings 5 so that the housings enclosing the fuses stand upright on the mounting board, parallel to one another. The two recessed parts 4*c* of each housing are then gripped between the adjacent retaining pieces on both sides of the center raised part 4*b* and thus the housing is securely held in upright position.

It will be readily understood from the above explanation that major parts of the fuse assemblies are exposed to the ambient air, providing an excellent cooling effect. This fact then enables compact arrangement of the multiple fuse elements on the limited area of the mounting board, because large-area socket openings are no longer necessary. Furthermore, with such efficient cooling, the current rating per fuse assembly can be raised without incurring an overheating problem, and accordingly the total number of fuses in use can be reduced. Thus the space and expenses required for fuse mountings are materially saved. Facility and convenience in exchanging the fuses should also be appreciated in accordance with the invention, since the standing fuses can be easily grasped by operator's fingers and replacement is accomplished by lightly pulling the used fuses out of the slits and fitting new ones into the same.

It should be understood that numerous modifications may be made in the preferred form of the invention described and especially other different arrangements of socket openings and retaining pieces are possible without deviating from the basic concept of plug-in type fuses standing upright on the mounting board.

What is claimed is:

1. A plug-in fuse arrangement comprising:

a fuse mounting board having a plurality of socket openings, multiple fuse assemblies each including a plate-like fuse body having two terminal-forming, parallel, bottom-end blade portions, a vertically elongate housing for each fuse assembly, enclosing the fuse body and leaving exposed the bottom ends of the blade portions, and retaining pieces formed upright on said mounting board so that said vertically elongate housing is vertically and securely retained between adjacent retaining pieces and against a surface of said fuse mounting board, whereby said bottom ends of the blade portions project downwardly from the housing and are fitted in said socket openings.

2. An arrangement according to claim 1, in which each socket opening consists of two longitudinally spaced aligned slits to fittedly receive said bottom ends of the fuse blade portions.

3. An arrangement according to claim 2, in which the retaining pieces comprise interspaced plate-shape members formed upright on the mounting board in two parallel juxtaposed rows extending at right angle to the slits and having one said slit lying between each adjacent pair of plate-shape members of a row.

* * * * *